US007174025B2

(12) United States Patent
Azima et al.

(10) Patent No.: US 7,174,025 B2
(45) Date of Patent: Feb. 6, 2007

(54) RESONANT PANEL-FORM LOUDSPEAKER

(75) Inventors: Henry Azima, Cambridge (GB); Denis Morecroft, Cambridgeshire (GB)

(73) Assignee: New Transducers Limited (GB)

( * ) Notice: Subject to any disclaimer, the term of this patent is extended or adjusted under 35 U.S.C. 154(b) by 0 days.

(21) Appl. No.: 11/023,386

(22) Filed: Dec. 29, 2004

(65) Prior Publication Data

US 2005/0129267 A1 Jun. 16, 2005

Related U.S. Application Data

(63) Continuation of application No. 09/752,830, filed on Jan. 3, 2001, now abandoned, which is a continuation of application No. PCT/GB99/01974, filed on Jul. 1, 1999.

(30) Foreign Application Priority Data

| | | |
|---|---|---|
| Jul. 3, 1998 | (GB) | 9814324.1 |
| Feb. 6, 1999 | (GB) | 9902578.5 |
| Feb. 6, 1999 | (GB) | 9902579.3 |
| Feb. 6, 1999 | (GB) | 9902581.9 |
| Feb. 6, 1999 | (GB) | 9902582.7 |
| Mar. 5, 1999 | (GB) | 9905038.7 |

(51) Int. Cl.
*H04R 7/04* (2006.01)

(52) U.S. Cl. ..... 381/152; 381/162

(58) Field of Classification Search ..... 381/152, 381/89, 332, 333, 306, 388, 398, 423, 431, 381/426, 162; 361/681, 682, 683, 686
See application file for complete search history.

(56) References Cited

U.S. PATENT DOCUMENTS

| | | | | |
|---|---|---|---|---|
| 1,500,331 | A | 7/1924 | Marriott | |
| 3,247,925 | A * | 4/1966 | Warnaka | 381/398 |
| 3,347,335 | A | 10/1967 | Watters et al. | |
| 3,482,241 | A * | 12/1969 | Johnson | 345/174 |
| 3,509,290 | A | 4/1970 | Mochida et al. | |
| 3,696,409 | A * | 10/1972 | Braaten | 345/173 |
| 4,352,961 | A | 10/1982 | Kumada et al. | |
| 5,400,414 | A | 3/1995 | Thiele | |
| 5,796,854 | A | 8/1998 | Markow | |
| 6,031,926 | A | 2/2000 | Azima et al. | |
| 6,058,196 | A | 5/2000 | Heron | |
| 6,324,052 | B1 | 11/2001 | Azima et al. | |

(Continued)

FOREIGN PATENT DOCUMENTS

| | | |
|---|---|---|
| EP | 0 361 249 A1 | 4/1990 |

(Continued)

OTHER PUBLICATIONS

Patent Abstracts of Japan, vol. 010, No. 228 (E-426), Aug. 8, 1986 & JP 61 061598 (Matsushita Electric Industries Co., Ltd.), Mar. 29, 1986.

*Primary Examiner*—Daniel Swerdlow
(74) *Attorney, Agent, or Firm*—Foley & Lardner LLP

(57) ABSTRACT

A loudspeaker assembly comprising a visual display screen, a resonant panel-form member positioned adjacent to the display screen, and a vibration exciter to cause the panel-form member to resonate as an acoustic resonator. At least a portion of the panel-form member is transparent, through which portion the display screen is visible.

37 Claims, 9 Drawing Sheets

U.S. PATENT DOCUMENTS

| | | | |
|---|---|---|---|
| 6,522,760 | B2 | 2/2003 | Azima et al. |
| 2005/0002537 | A1 | 1/2005 | Azima et al. |

FOREIGN PATENT DOCUMENTS

| | | | |
|---|---|---|---|
| FR | 2 649 575 | | 1/1991 |
| JP | 61-061598 | | 3/1986 |
| WO | WO 92/03024 | A1 | 2/1992 |
| WO | WO 97/09842 | A2 | 3/1997 |
| WO | WO 99/37121 | A1 | 7/1999 |

* cited by examiner

FIG.7a
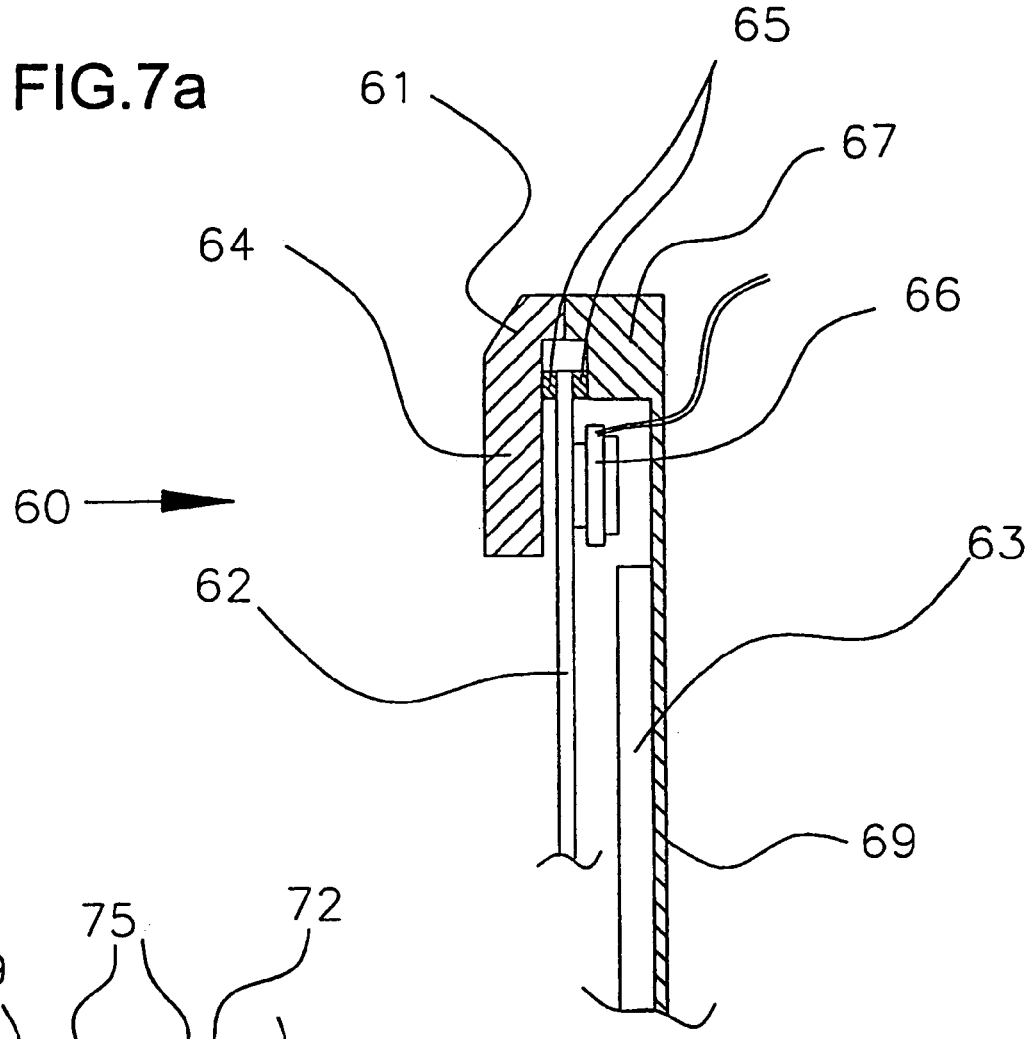
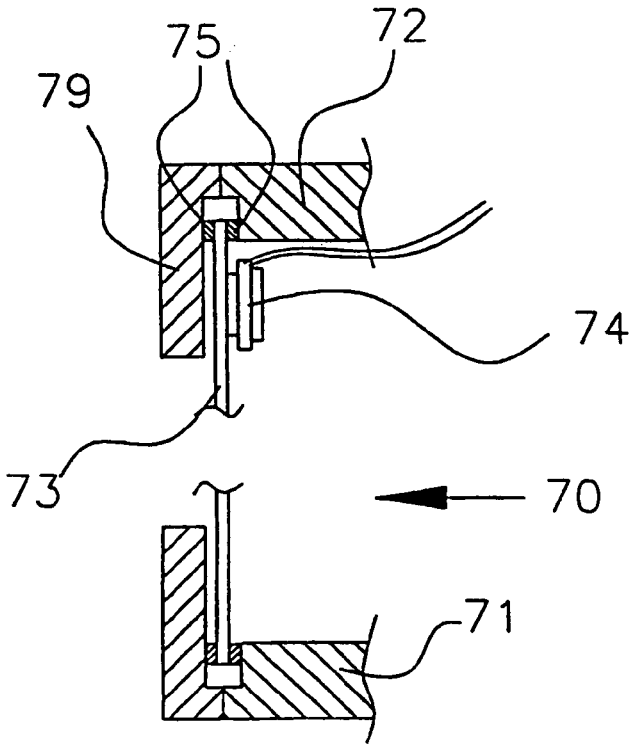
FIG.7b

FIG.8
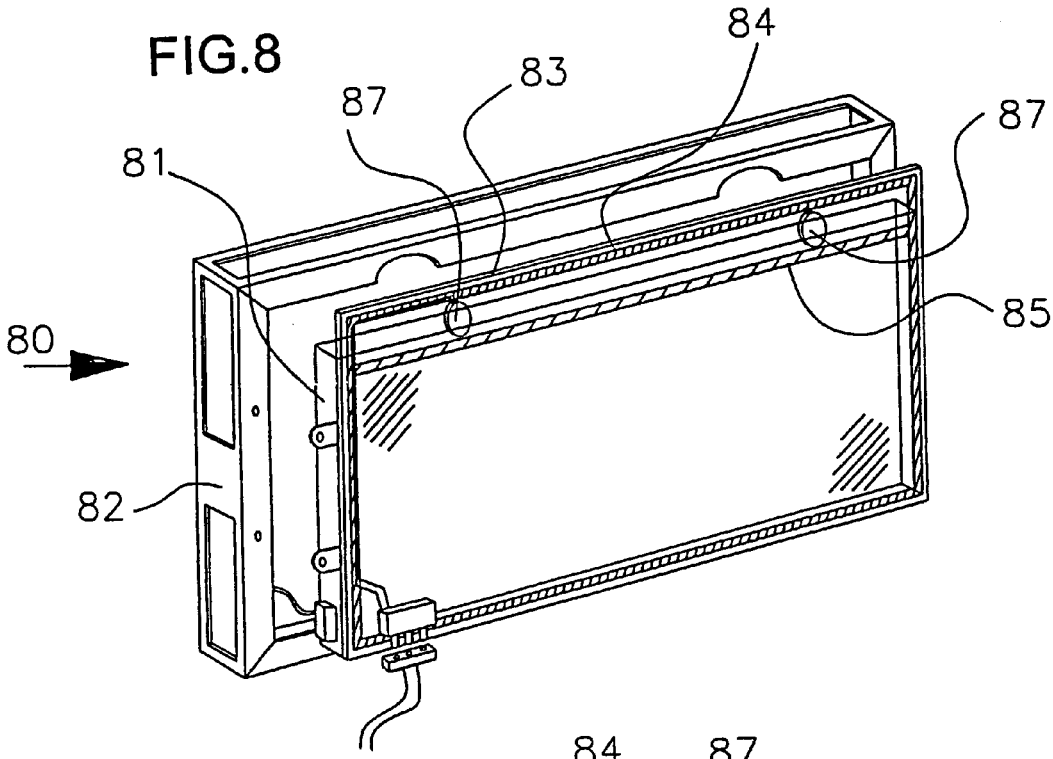
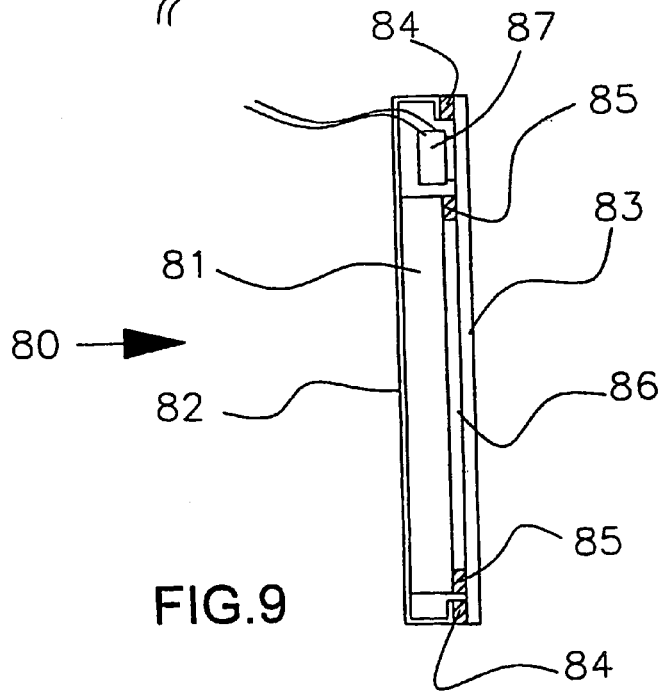
FIG.9

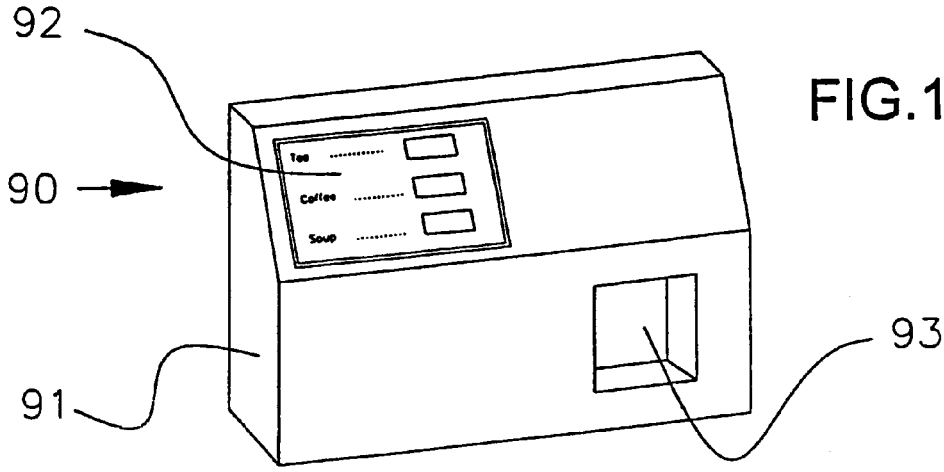
FIG.10
FIG.11
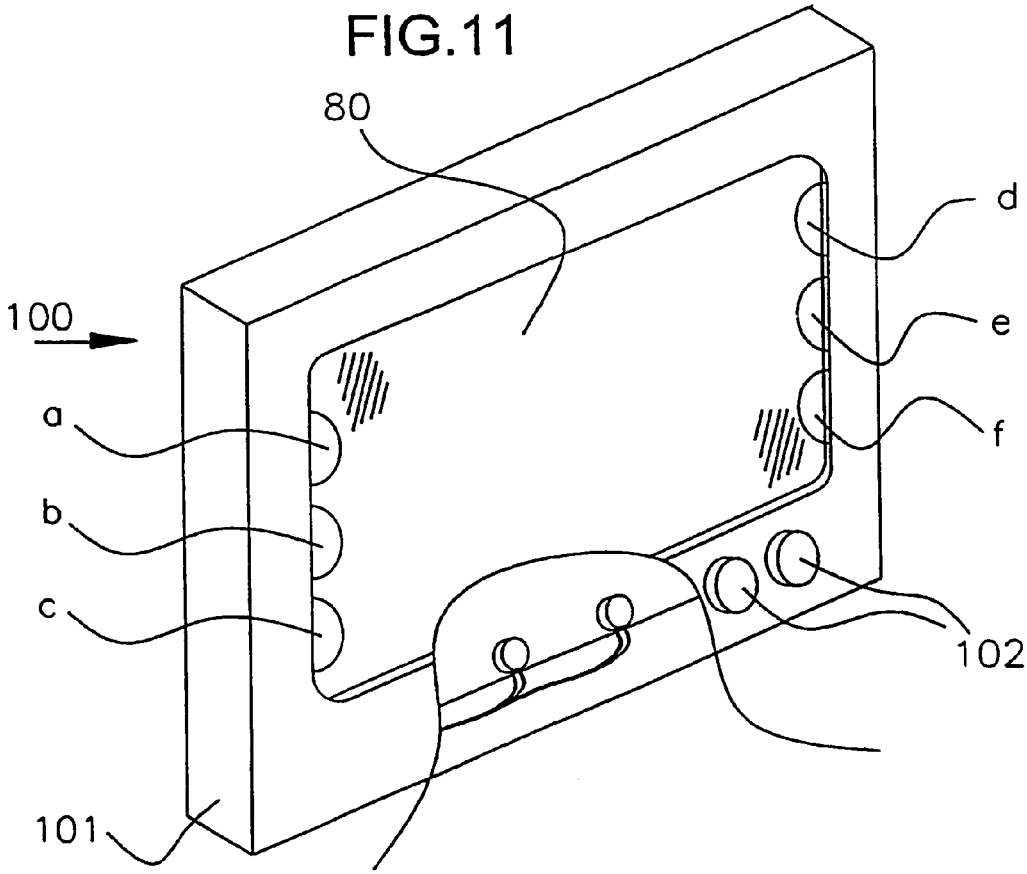

RESONANT PANEL-FORM LOUDSPEAKER

CROSS-REFERENCE TO RELATED APPLICATIONS

This application is a continuation of, and incorporates by reference, Ser. No. 09/752,830, filed Jan. 3, 2001, now abandoned which is a continuation of PCT/GB99/01974, filed Jul. 1, 1999.

BACKGROUND

The invention relates to loudspeakers and, more particularly, to resonant panel-form loudspeakers and panel-form loudspeaker assemblies either alone or when integrated with another article, e.g. a picture frame, display cabinet, visual display screen, mirror and the like incorporating translucent or transparent glass-like panels, or laptop and the like personal computers including personal organisers, hand-held and the like computers having a display screen or hand-held and the like telephone receivers, e.g. mobile telephones having a display screen, and to modules comprising a display screen which can be driven as a loudspeaker for incorporation into an article such as those set out above.

Such resonant panel-form loudspeakers are generally described in U.S. Pat. No. 6,332,029, and have become known as distributed mode (or DM) loudspeakers (or DML).

It is known to suggest driving the transparent face of a wristwatch to act as a buzzer or sounder i.e. to emit simple sound tones, e.g. to act as an alarm for the wearer of the wristwatch.

It is among the objects of the invention to provide a resonant transparent panel-form member which can be driven as a loudspeaker, e.g. to reproduce speech or music.

It is another object of the invention to enhance the functionality of a resonant panel loudspeaker to enable direct user input.

SUMMARY DISCLOSURE OF THE INVENTION

According to the invention a loudspeaker assembly comprises a display screen, a resonant panel-form member, at least a portion of which is transparent and through which the display screen is visible, and a vibration exciting transducer to cause the panel-form member to resonate to act as an acoustic radiator.

From one aspect the invention is a display screen module e.g. for a visual display unit (VDU), comprising a display screen, a resonant panel-form member, at least a portion of which is transparent and through which the display screen is visible, and a vibration exciting transducer to cause the panel-form member to resonate to act as an acoustic radiator or loudspeaker.

From another aspect the invention is an article of the nature of a picture frame or holder, display cabinet, visual display apparatus, mirror or the like having an article area or surface to be viewed, comprising a resonant panel-form member, at least a portion of which is transparent or translucent through which the display area or surface or article is visible, or at least through which light from the display area is transmittable, and vibration exciting transducer to cause the panel-form member to resonate to act as an acoustic radiator or loudspeaker.

From another aspect the invention is a telephone receiver or the like, e.g. a mobile telephone or cell phone, comprising a display screen, a resonant panel-form member, at least a portion of which is transparent and through which the display screen is visible, and vibration exciting transducer to cause the panel-form member to resonate to act as an acoustic radiator or loudspeaker.

The resonant panel-form member may be of rigid plastics, e.g. polystyrene, or may be of glass or other rigid transparent material.

More than one vibration exciting transducer may be provided to apply bending wave energy to the panel-form member to cause it to resonate to produce an acoustic output. Such plural vibration exciters may be driven with the same signal to give a monaural output, or may be driven separately to provide multi-channel, e.g. stereo, output.

The or each vibration exciter may be mounted to an edge or marginal portion of the panel-form member or to a portion of the panel-form member outside its transparent portion. The marginal mounting may be as described in U.S. Pat. No. 6,522,760, which is incorporated herein by reference. The vibration exciters may be mounted in pairs to an edge or marginal portion or to opposite edges or marginal portions of the panel-form member or to other portions of the member outside its transparent portion. The or each vibration exciter may be coupled directly to the panel-form member. The vibration exciters may be electrodynamic or piezoelectric. The vibration exciters may comprise an inertial device or may be partly or fully grounded. The exciter(s) may be resiliently supported, e.g. on an associated frame member, e.g. the lid of the laptop computer.

The panel-form member may be resiliently supported on the frame along one or more edges. Thus, where the panel is rectangular, the resilient suspension may extend along three adjacent edges and the exciter(s) may be provided on the fourth edge. Alternatively all four edges of the panel may be resiliently supported.

The vibration exciters may alternatively or additionally comprise a piezoelectric (e.g. of PVDF or PLZT material) or an electret film, e.g. a transparent piezoelectric or an electret film. The piezoelectric or electret material may be laminated or fused or otherwise bonded or embedded onto or into a part or the whole of the panel-form member, whether of glass, plastics or a composite of glass and plastics. Transparent conductors may also be provided on or in the panel to energise the vibration exciters.

The loudspeaker or loudspeaker assembly may be of the general kind described in U.S. Pat. No. 6,332,029. Thus the loudspeaker may comprise a member capable of sustaining and propagating input vibrational energy by bending waves in at least one operative area extending transversely of thickness to have resonant mode vibration components distributed over said at least one area and having a vibration exciter mounted on said member to vibrate the member to cause it to resonate forming an acoustic radiator which provides an acoustic output when resonating.

One or more marginal portions of the panel-form member may be clamped or restrained. The whole periphery of the panel-form member may be mechanically clamped.

The panel-form member may be mounted in means enclosing one face of the panel-form member whereby acoustic radiation from the said one face is at least partly contained within the enclosure or cavity, in the manner of an infinite baffle loudspeaker. The enclosure or cavity may be such as to modify the modal behaviour of the panel as described in U.S. Pat. No. 6,553,124, which is incorporated herein by reference.

The panel-form member may form the face of a visual display unit or the like, e.g. the outer transparent protective surface of or over the visual display screen, e.g. a liquid crystal display or plasma display of a lap-top or the like computer. A polymer-film liquid crystal display may be bonded or otherwise mounted on or integrated with the panel-form member, whereby the loudspeaker and visual display functions are integrated.

The resonant panel-form member may have a user-accessible surface and means on or associated with the surface and responsive to user contact. The user-responsive means may act as a touch control means, e.g. whereby the user can enter instructions or provide information, e.g. to apparatus associated with the loudspeaker.

Thus for example the loudspeaker may form a control panel, e.g. for a vending machine of the kind described in U.S. Pat. No. 6,332,029, or may control operation of a computer.

The user-responsive means may comprise visible or invisible areas, delineated by printing or labelling as required or, if visible, by a contact or metallisation, which may use capacitative or conductive or alternative methods of sensing the immediate presence or contact by a person, finger etc. Pressure switches may also be attached to the surface or embedded within. For both transparent and translucent speaker types these and other well-known methods may be used.

The resonant speaker panel may also be combined with other methods for sensing which include matrices of light emitting devices and receptors, e.g. photodiodes and/or photocells round the perimeter of the panel and which sense the position, e.g. of a finger directed at a point on the panel.

Where metallised contacts are used these may be of the metal oxide film or thin metal film type and may thereby be rendered transparent if required, including the related wiring. Thus both the contact areas and the connective wiring to the edge of the panel may be designed so as not to impair the optical properties of the panel.

Applications include touch screen control for transparent computer and video display resonant panel loudspeakers, for translucent display and lighting resonant panel speakers, and for automated ticket machine (ATM) and vending machine applications. Many other categories are indicated, for example in consumer electronics such as a speaking or sound informing resonant touch panel for a remote control unit, whether illuminated or not, or applied to a mobile telephone display of suitable area, or combining a display, a loudspeaker and a control panel with illumination. With the development of mobile video telephones the concept offers further engineering value with the transparent touch type speaker panel also forming part of the video display assembly or associated design.

User feedback of control settings via the resonant speaker panel with incorporated switch buttons would find utility in the control sections of hi-fi and audio equipment, particularly where complex setting up is required, for example in home theatre systems.

Also domestic appliances, e.g. dishwashers, washing machines, would benefit from the addition of this technology, as would industrial instrumentation, display orientated instructions such as analysers and oscilloscopes.

The invention could be applied to laptop and other computer controls, points of sales data systems, personal, stock control and labelling devices, and also to automotive navigation units, dashboard displays with a "window" comprising a resonant panel speaker design, point of sale products with sound output and facility for user/customer data entry or control of operational information, and similarly for educational display units for museums, zoos, etc., and interactive audio visual devices.

BRIEF DESCRIPTION OF THE DRAWINGS

The invention and the best mode(s) for carrying it out are described in detail below in conjunction with examples that are diagrammatically illustrated in the accompanying drawings, in which:

FIGS. 7*a* and 7*b* are partial scrap cross-sectional views through the picture frame assembly of FIG. 5 and the display case of FIG. 6, respectively;

FIG. 8 is a perspective view of a display screen module which integrates the functions of the display screen with that of a loudspeaker;

FIG. 9 is a cross-sectional view through the module of FIG. 8;

FIG. 10 is a perspective view of a vending machine incorporating a combined loudspeaker/display screen of the present invention;

FIG. 11 is a perspective view of a visual display unit, such as a television, incorporating the combined loudspeaker/display screen of the present invention;

DETAILED DESCRIPTION

Figure 1:
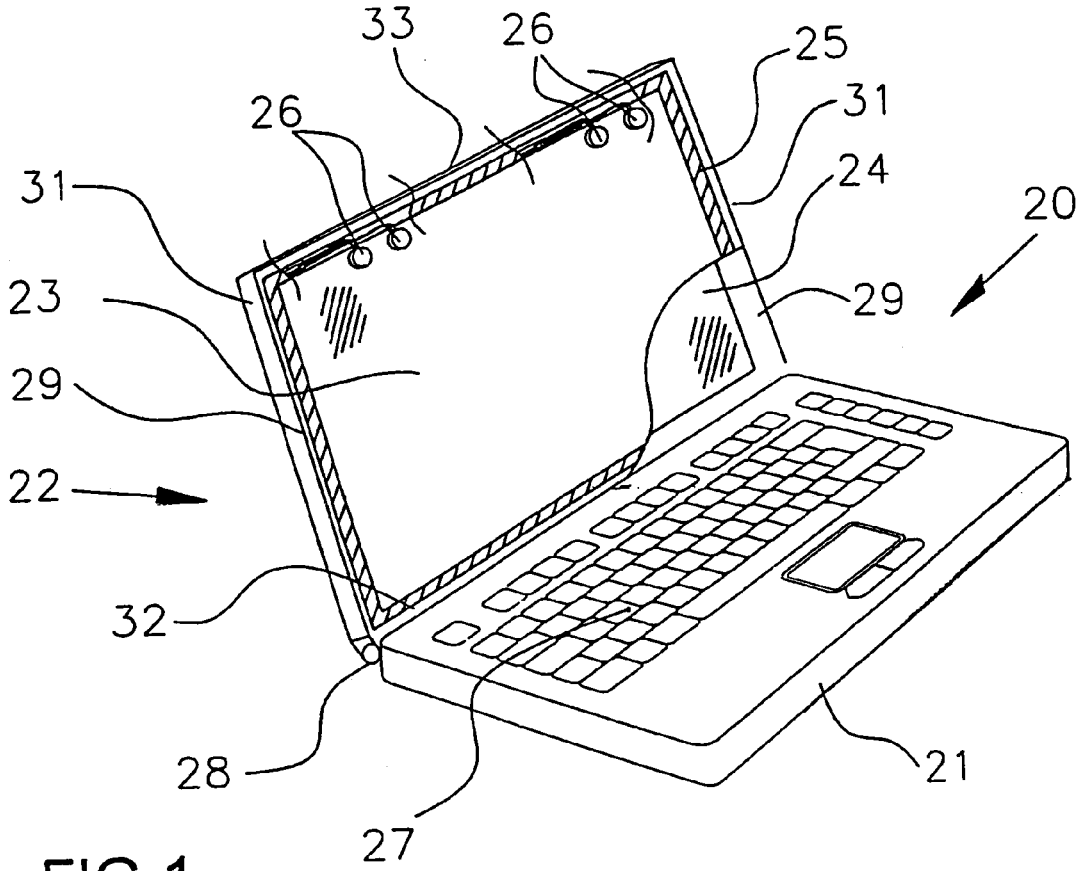
FIG. 1 is a perspective view of a laptop computer with the lid raised to show a computer keypad and a display screen.
Figure 2:
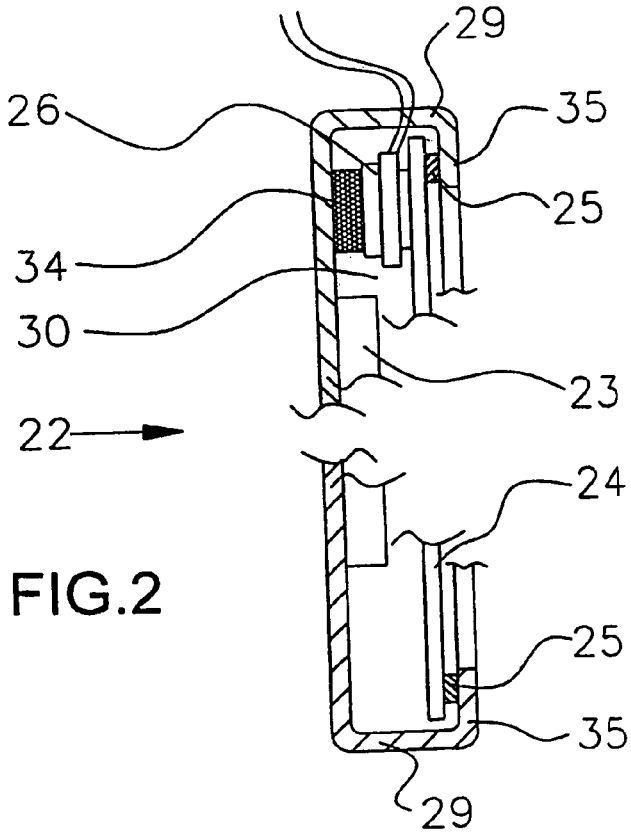
FIG. 2 is a partial cross-sectional view through the lid of the laptop computer of FIG. 1.

In FIGS. 1 and 2 of the drawings a laptop computer 20 comprises a body 21 having a keypad 27 and a lid 22 hinged at 28 to the body to overlie the keypad when closed and to disclose a visual display screen 23 when raised or opened as shown. In FIG. 1, the lid is shown partly broken away to reveal hidden detail.

The laptop lid 22 is formed with a surrounding peripheral lip 29 to define a shallow container or enclosure 30 in which is mounted a liquid crystal display (LCD) screen 23 visible through a rectangular transparent protective cover 24 in the form of a resonant panel-form member, e.g. of the general kind described in U.S. Pat. No. 6,332,029, suspended in the lid along all four edges, i.e. the two side edges 31 the top edge 33 and the bottom edge 32, by means of an interposed resilient suspension 25, e.g. of foamed rubber strip. Two pairs of moving coil inertial vibration exciters 26 are mounted on the top edge 33 of the panel-form cover 24 near to the sides 31 to drive the panel to resonate to act as a loudspeaker, and the exciters are supported on resilient suspensions 34, e.g. of foamed rubber, fixed to the lid. The exciters are hidden behind a return flange 35 of the peripheral lip 29 and thus are invisible in use.

Although the pairs of exciters are shown attached to the top edge of the panel, it might be preferable, where multichannel, e.g. stereo, audio operation is required, to separate the pairs of exciters still further by mounting them on opposite sides of the panel, to provide better stereo separation.

The transparent panel-form member 24 may be of polystyrene, polycarbonate or similar or a composite of glass and plastics, e.g. a plastics or aerogel core with glass skins. Where the panel-form member has a plastics face, it may be given a scratch resistant coating.

Figure 3:
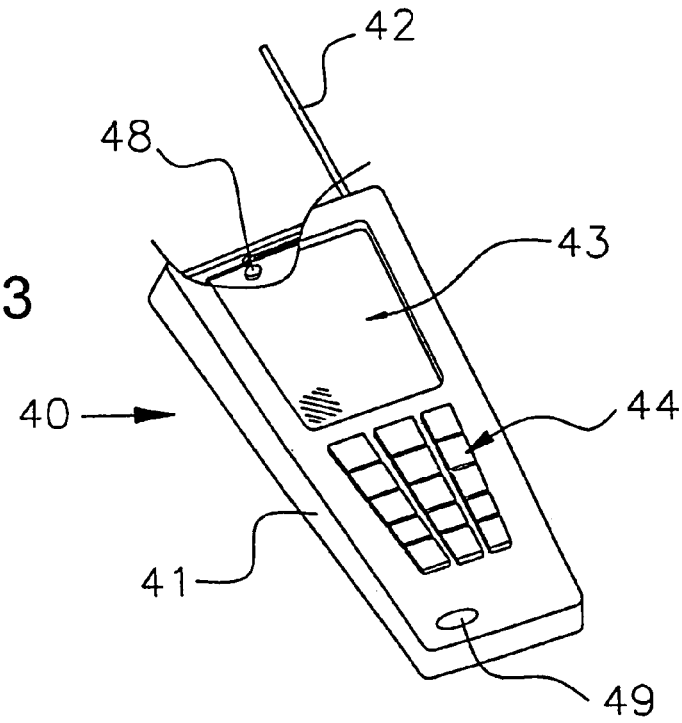
FIG. 3 is a perspective view of a mobile radio, telephone or cell phone having a keypad and a display screen.
Figure 4:
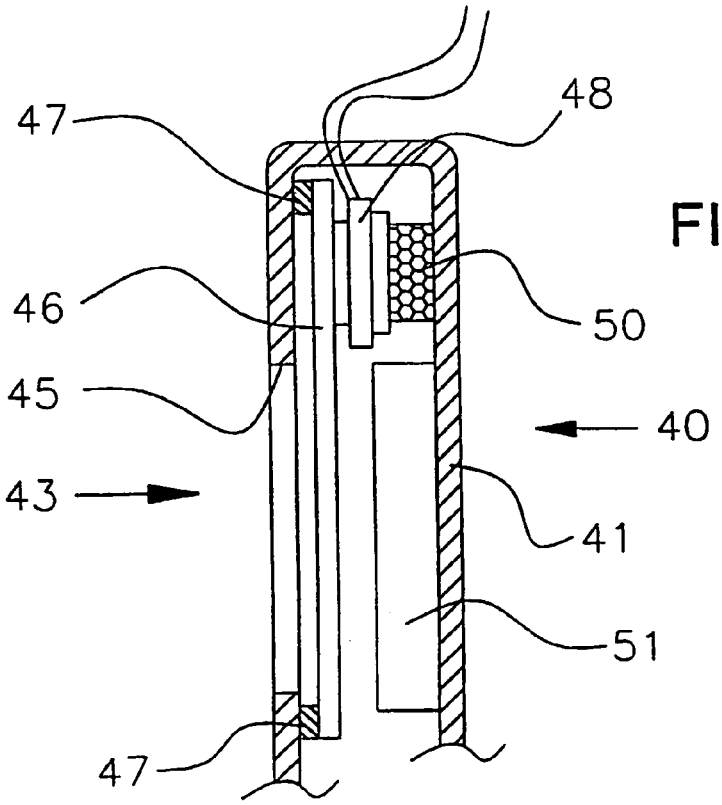
FIG. 4 is a partial longitudinal cross-sectional view through the mobile telephone of FIG. 1.

In FIGS. 3 and 4 of the drawings a mobile radio telephone or cell phone 40 comprises a casing 41 containing, in conventional fashion, a radio transmitter and receiver (not shown), an aerial 42 projecting from the casing for sending and receiving radio signals, a display screen 43 mounted in the casing, a keypad 44 in the casing adjacent to the display screen and through which the device is operated, and a microphone 49.

As shown in FIG. 4 the casing 41 is formed with an aperture defined by a surrounding peripheral lip 45 below which is mounted the display screen generally indicated by reference 43, and comprising, e.g., a liquid crystal display (LCD) 51, which is visible through a rectangular transparent protective cover 46 in the form of a resonant panel-form member. The panel-form member covers the aperture and is suspended in and sealed to the casing along its periphery by means of resilient suspension, e.g. of foamed rubber strip 47, interposed between the inner face of the lip 45 and the peripheral margin of the panel-form member 46.

An inertial moving coil vibration exciter 48 is mounted on the top edge of the transparent panel-form cover member to drive the panel to resonate to act as a loudspeaker in the general manner taught in U.S. Pat. No. 6,332,029. The exciter 48 is supported on a resilient suspension 50, e.g. of foamed rubber, fixed to the casing. The exciter is hidden behind the peripheral lip 45 of the aperture in the casing and thus is invisible in use. The transparent panel-form member may be of polystyrene, polycarbonate or similar or a composite of glass and plastics, e.g. a plastics or aerogel core with glass skins. Where the panel-form member 46 has a plastics face, it may be given a scratch-resistant coating.

It is intended that the loudspeaker may be used normally, i.e. with the loudspeaker placed adjacent the user's ear for privacy, or with the volume raised as a "hands free" telephone. A mechanical buzzer, i.e. a no-sound alert, may be incorporated in the loudspeaker. Such a buzzer may utilise the vibration exciter 48 or may be a separate device.

Figure 5:
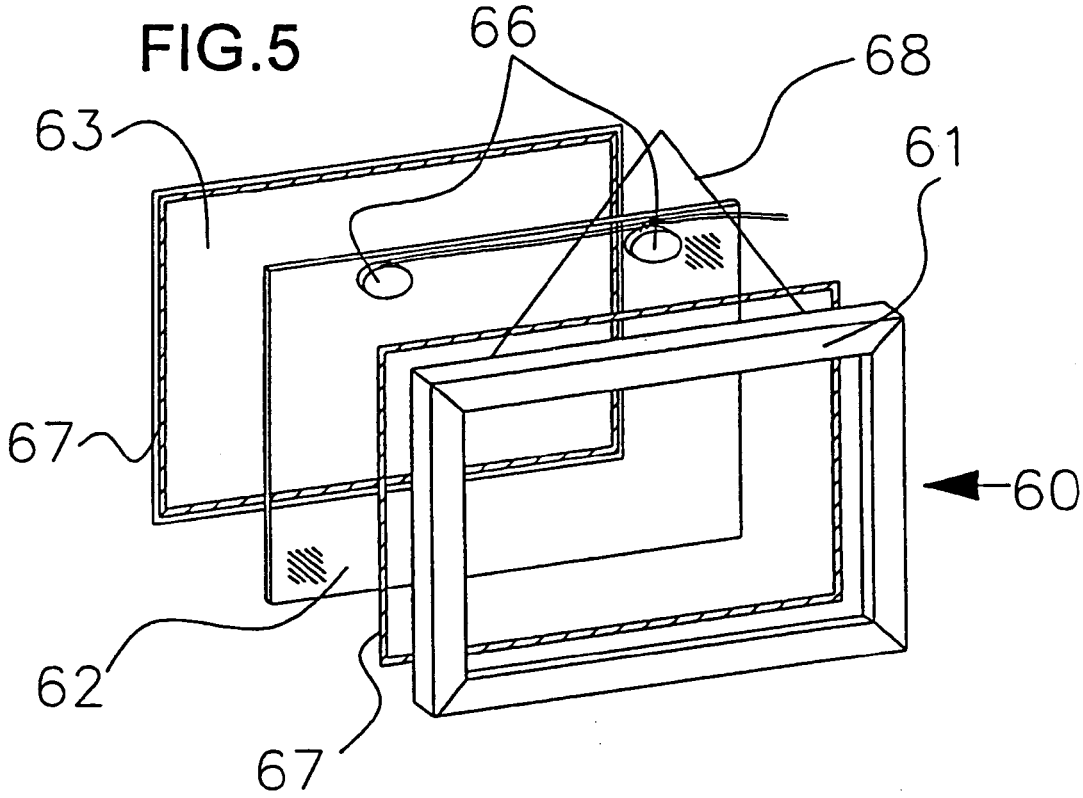
FIG. 5 is an exploded perspective view of a picture frame assembly intended for wall mounting and combined with a loudspeaker.

FIG. 5 shows a wall hanging picture or photograph frame assembly 60 comprising a rectangular front frame 61 having a hanging wire 68 adapted to engage a wall hook to support the picture in position, and a rectangular transparent panel-form member 62 forming a protective cover over a picture 63. As can be seen from FIG. 7*a*, the front frame 61 is formed with a surrounding peripheral lip 64 defining an aperture through which the picture/photograph 63 or the like is visible through the transparent protective cover 62, which is in the form of a resonant panel-form member resiliently suspended in the frame 61 along its periphery by means of an interposed resilient suspension 65, e.g. of foamed rubber strip. A back frame 67 mates with the front frame 61 and carries a second resilient suspension 65 whereby the periphery of the panel 62 is supported from both sides. The back frame 67 carries a picture back 69 on which the picture 63 is mounted in any convenient fashion.

Two moving coil inertial vibration exciters 66 are mounted on the top edge 67 of the panel-form cover member to drive the panel to resonate to act as a loudspeaker. The exciters are hidden behind the peripheral lip 64 and thus are invisible in use. The panel-form member may be of transparent polystyrene, polycarbonate or similar or a composite of glass and plastics, e.g. a plastics or aerogel core with glass skins. Where the panel-form member has a plastics face, it may be given a scratch resistant coating. With this arrangement the picture may easily be changed when desired.

Although the arrangement of FIG. 5 is intended for wall mounting, it will be appreciated that the picture/photograph frame assembly 60 could, if desired, be made to be free-standing with the addition of a generally conventional rear stand.

Figure 6:
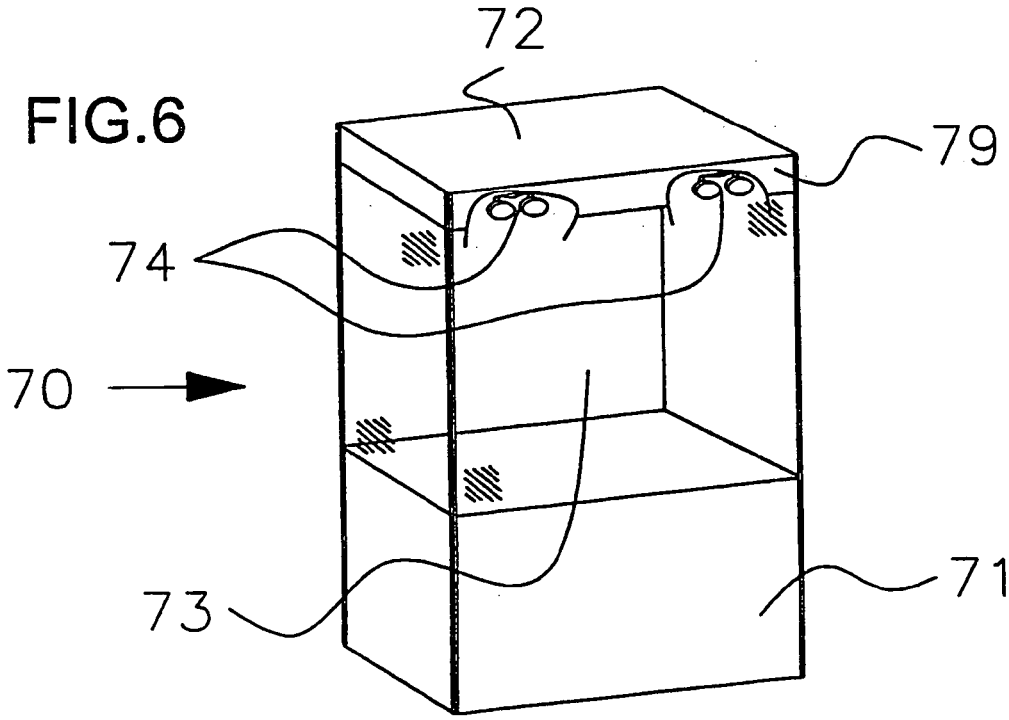
FIG. 6 is a perspective view of a display case, e.g. for a shop or museum, incorporating a loudspeaker and partly broken away to show hidden detail.

FIG. 6 shows a free-standing display cabinet 70, which is generally cuboid and comprises a plinth 71, a top 72, and four transparent display windows 73, one on each side of the cabinet, extending between the plinth and top. In this cabinet one or more, e.g. all four, windows 73 can be arranged to act as resonant panel-form loudspeakers with the aid of vibration exciters 74, substantially in the manner described in U.S. Pat. No. 6,332,029.

The display cabinet 70 of FIGS. 6 and 7*b* is constructed and functions in much the same manner as is shown in FIGS. 5 and 7*a* with respect to the picture frame assembly 60. Thus the rectangular resonant transparent panel-form member 73 is resiliently suspended between foam rubber or the like strips 75 in the top 72 and plinth 71 of the cabinet and inertial vibration exciters 74 are mounted on the panel 73 behind a flange 79 on the top 72 so as to be hidden thereby. The transparent panel can thus be driven to resonate to act as loudspeakers, e.g. to add an audio element to the display of goods or an artefact in the cabinet.

The transparent panels 73 may be constructed as described above.

FIGS. 8 and 9 of the drawings show a module 80 comprising a visual display screen and a resonant panel-form loudspeaker generally of the kind described with reference to the embodiment of FIGS. 1 and 2 above. In this case the module 80 is intended to form a self-supporting unit, which can be manufactured for later assembly to form a finished article, e.g. a television, VDU or the like. The module comprises a generally rectangular frame 82 which may be of lightweight pressed metal, in or on which is rigidly mounted a visual display screen 81, e.g. a liquid crystal display, and over which screen 81 is resiliently suspended a rectangular transparent resonant panel-form member 83. The panel-form member 83 is suspended on a peripheral resilient strip 84 of foam rubber or the like supported on the frame 82. A resilient seal/suspension 85, e.g. of foam rubber strip is interposed between the edge of the screen 81 and the panel 83 to form a cavity 86 therebetween. Vibration exciters 87 are mounted on the peripheral margin of the panel 83 at positions outside the area of the screen 81 to excite the panel to resonate to act as a loudspeaker.

FIG. 10 illustrates a vending machine 90 comprising a cabinet 91 having control panel 92 and a delivery or dispensing chute 93. The control panel 92 comprises a combined visual display and audio module 80 as described above in relation to FIGS. 8 and 9 to facilitate the functioning of the vending machine, and may also comprise additional functions as described below.

FIG. 11 shows a visual display device 100 comprising a cabinet 101 housing a combined visual display/loudspeaker module 80 as described above in relation to FIGS. 8 and 9, the cabinet 101 having generally conventional control buttons or knobs 102. The opposite sides of the transparent panel 83 forming the front cover over the display screen are formed with areas a to f, respectively, which are touch pads whereby the user can control the functioning of the device 100 simply by touching the appropriate pad.

Figure 12:
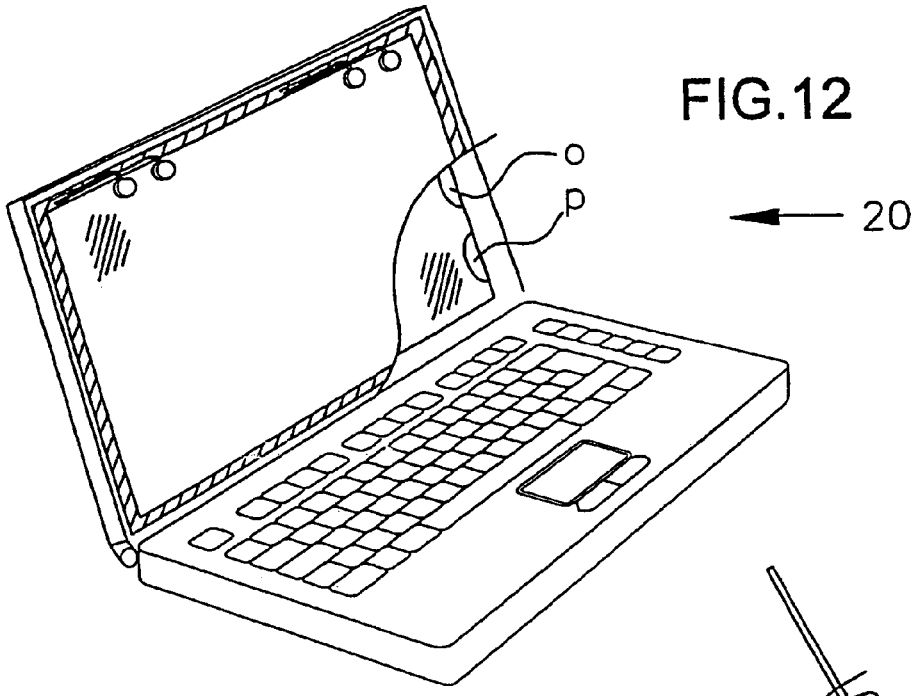
FIG. 12 is a perspective view of a laptop computer generally of the kind shown in FIG. 1 and in which the display screen comprises a touch pad.
Figure 13:
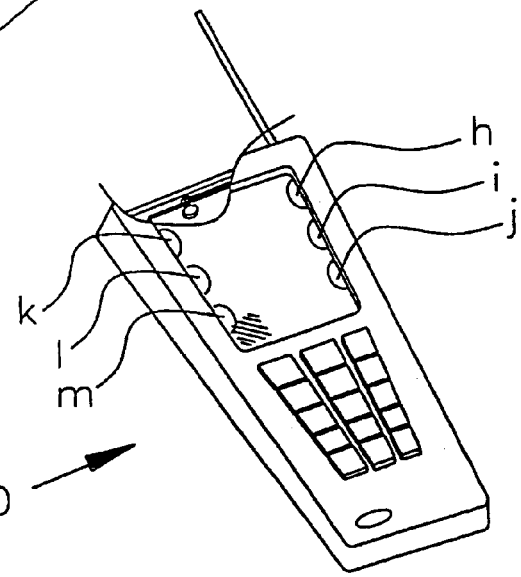
FIG. 13 is a perspective view of a mobile telephone generally of the kind shown in FIG. 3 and in which the display screen comprises a touch pad.

FIGS. 12 to 16 show how touch pads can be applied to previously described embodiments of the invention. Thus FIG. 12 shows touch pads o, p applied to the screen of a laptop computer 20, while FIG. 13 shows touch pads h to m applied to the screen of a mobile telephone 40.

Figure 14:
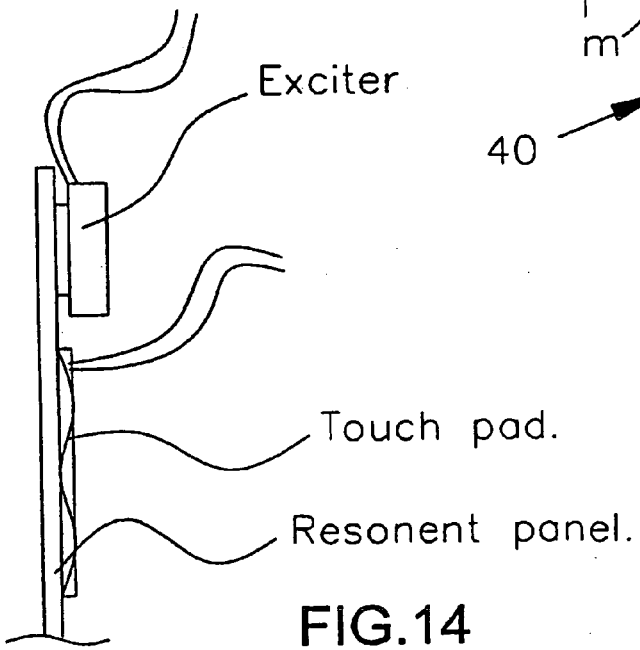
FIG. 14 is a partial cross-sectional side view of a combined resonant panel loudspeaker and touch pad.

FIG. 14 is a cross-sectional sketch showing the touch pads on a resonant panel.

Figure 15:
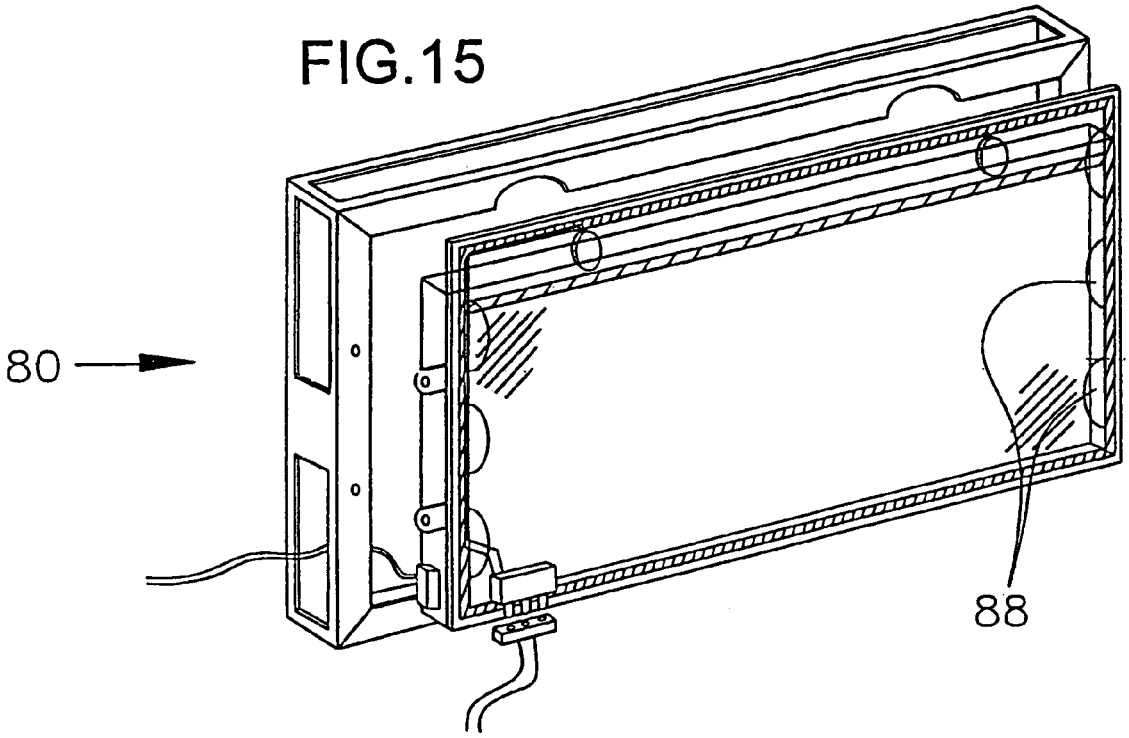
FIGS. 15 and 16 are, respectively, an exploded perspective view and a cross-sectional side view of a module generally as shown in FIGS. 8 and 9 and comprising a touch pad.
Figure 16:
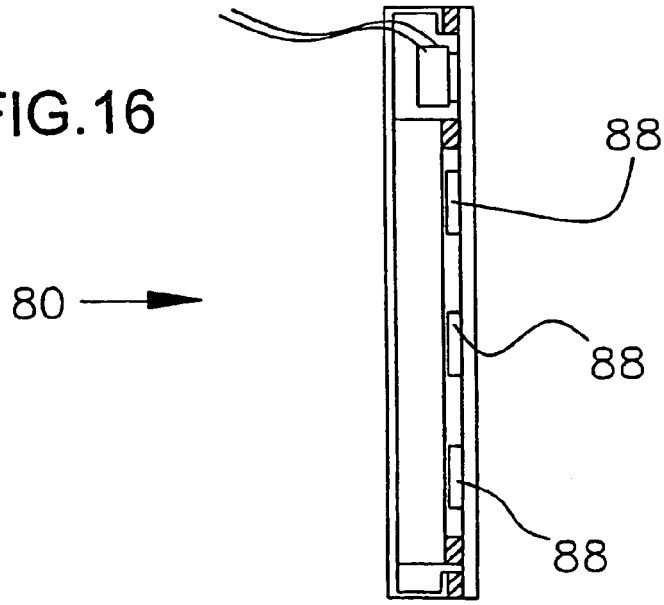

FIGS. 15 and 16 show touch pads 88 applied to the resonant panel of a module 80 of the kind shown in FIGS. 8 and 9.

Figure 17:
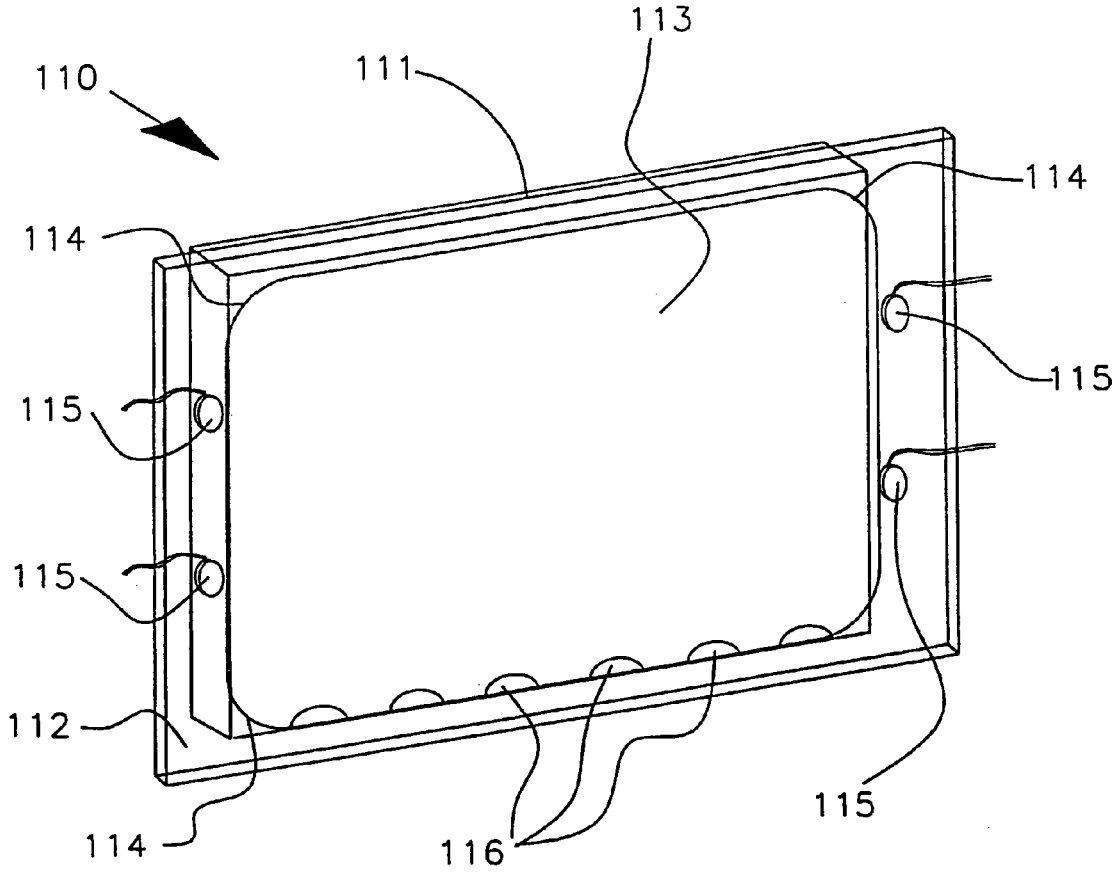
FIG. 17 is a partial diagrammatic perspective view of a display screen/loudspeaker assembly applied to a television.

FIG. 17 shows how the present invention can be applied to a cathode ray tube or plasma screen television 110. It is to be noted that only the salient features of the invention are shown in the drawings. The case or cabinet of the television is omitted in the interests of clarity although the case or cabinet will function to support the combined visual display 111 and loudspeaker, much as the lid of the laptop computer of FIGS. 1 and 2 functions to support the display/loudspeaker.

As shown in the drawing, a rectangular resonant panel 112 is disposed in front of the visual display 111 and the panel 112 is formed with a transparent window 114 having rounded corners 114. Vibration exciters 115 are disposed on the marginal portions of the panel 112 outside the window 113, and on opposite sides thereof. Touch pads 116 are positioned along the lower edge of the window. If desired the portion of the panel-form member outside the window may act as a mask to hide associated componentry, or a separate mask may be positioned over the panel-form member.

The invention thus provides an assembly combining the functions of a visual display and loudspeaker(s) which enables the manufacture of a thin, space-efficient VDU or television or the like.

The invention claimed is:

1. A loudspeaker assembly comprising a visual display screen, a panel-form member positioned adjacent to the display screen and at least a portion of which is transparent and through which the display screen is visible, and at least one vibration exciting transducer mounted to an edge or marginal portion of the panel-form member to cause the panel-form member to act as an acoustic radiator, wherein the panel-form member is adapted to be resonant when excited at audio frequencies to undergo bending wave vibration, wherein the vibration exciting transducer is adapted to apply bending wave energy to the panel-form member to cause it to undergo bending wave vibration and resonate to act as an acoustic radiator when resonating, and wherein one or more marginal portions of the panel-form member are clamped or restrained.

2. A loudspeaker assembly according to claim 1, wherein the whole of the resonant panel-form member is transparent.

3. A loudspeaker assembly as claimed in claim 1 or claim 2, wherein the panel-form member is of plastics.

4. A loudspeaker assembly as claimed in claim 1 or claim 2, wherein the panel-form member is selected from the group consisting of polystyrene, polycarbonate, glass and a laminate of plastics and glass.

5. A loudspeaker assembly according to claim 1 or claim 2, wherein the panel-form member is a laminate comprising a core of plastics or aerogel with skins of glass.

6. A loudspeaker assembly according to claim 1 or claim 2, comprising more than one vibration exciting transducer.

7. A loudspeaker assembly according to claim 1 or claim 2, comprising vibration exciting transducers mounted in pairs to at least one edge or marginal portion of the panel-form member.

8. A loudspeaker assembly according to claim 7, wherein the vibration exciting transducers are coupled directly to the panel-form member.

9. A loudspeaker assembly according to claim 1 or claim 2, wherein the vibration exciting transducer is coupled directly to the panel-form member.

10. A loudspeaker assembly according to claim 1 or claim 2, wherein the vibration exciting transducer is electrodynamic.

11. A loudspeaker assembly according to claim 1 or claim 2, wherein the vibration exciting transducer is inertial.

12. A loudspeaker assembly according to claim 1 or claim 2, comprising an associated support for the loudspeaker assembly.

13. A loudspeaker assembly according to claim 12, wherein the associated support is a frame or chassis.

14. A loudspeaker assembly according to claim 13, wherein the resonant panel-form member is resiliently supported on the associated support.

15. A loudspeaker assembly according to claim 14, wherein the vibration exciting transducer is resiliently mounted in the associated support.

16. A loudspeaker assembly according to claim 14, wherein the panel-form member is rectangular, and wherein a resilient panel support extends along at least three adjacent edges of the panel-form member.

17. A loudspeaker assembly according to claim 15, wherein the panel-form member is rectangular, and wherein a resilient panel support extends along at least three adjacent edges of the panel-form member.

18. A loudspeaker assembly according to claim 12, wherein the vibration exciting transducer is resiliently mounted in the associated support.

19. A loudspeaker assembly according to claim 1 or claim 2, wherein the vibration exciting transducer comprises a transparent piezoelectric or electret on or in at least a part of the panel-form member.

20. A loudspeaker assembly according to claim 1 or claim 2, wherein the whole periphery of the panel-form member is mechanically clamped.

21. A loudspeaker assembly according to claim 1 or claim 2, wherein the panel-form member is mounted in an associated cavity or enclosure enclosing a face of the panel-form member whereby acoustic radiation from the enclosed face is at least partly contained within the enclosure or cavity.

22. A loudspeaker assembly according to claim 21, wherein the enclosure or cavity is shallow in depth such as to modify the modal behaviour of the panel-form member.

23. A loudspeaker assembly according to claim 1 or claim 2, wherein the display screen is integral with the panel-form member.

24. A loudspeaker assembly according to claim 23, wherein the integral display screen comprises a light emitting surface.

25. A loudspeaker assembly according to claim 23, wherein the integral display screen comprises a light transmitting surface.

26. A loudspeaker assembly according to claim 23, wherein the integral display screen comprises a light reflective surface.

27. A loudspeaker assembly according to claim 1 or claim 2, wherein the panel-form member forms the external face of a visual display unit.

28. A loudspeaker assembly according to claim 1 or claim 2, comprising a polymer-film liquid crystal display bonded or otherwise mounted on the panel-form member.

29. A loudspeaker assembly according to claim 1, wherein the resonant panel-form member has a user-accessible surface and means on or associated with the surface and responsive to user contact.

30. A loudspeaker assembly according to claim 29, wherein the user-responsive means on the panel-form member allows instructions or information to be entered, and is selected from the group consisting of pads, areas, switches and buttons.

31. A loudspeaker assembly according to claim 29, wherein the user-responsive means comprises visible areas on the panel-form member, delineated by printing or labelling, which sense the presence or contact by a user.

32. A loudspeaker assembly according to claim 29, wherein the user-responsive means comprises metallised user responsive contacts of transparent metal oxide film or thin metal film on the panel-form member.

33. A loudspeaker assembly according to claim 29, wherein the user responsive means is positioned at the perimeter of the panel-form member.

34. A display screen module comprising a loudspeaker assembly as claimed in claim 1 or claim 2, and a chassis or frame supporting the display screen and supporting the transparent panel-form member.

35. A telephone receiver comprising a loudspeaker assembly as claimed in claim 1 or claim 2.

36. A portable personal computer comprising a loudspeaker assembly as claimed in claim 1 or claim 2.

37. A portable personal computer as claimed in claim 36, comprising a body having a key pad and a lid adapted to enclose the key pad and carrying a display screen, and wherein the display screen comprises the loudspeaker assembly.

* * * * *